United States Patent [19]

Rhodes

[11] 4,164,163

[45] Aug. 14, 1979

[54] ELECTRIC GUITAR CIRCUITRY

[75] Inventor: Orville J. Rhodes, Van Nuys, Calif.

[73] Assignee: Peavey Electronics Corp., Meridian, Miss.

[21] Appl. No.: 808,790

[22] Filed: Jun. 22, 1977

[51] Int. Cl.[2] ..... G10H 3/08

[52] U.S. Cl. ..... 84/1.15; 84/1.16

[58] Field of Search ..... 84/1.15, 1.16, 1.14

[56] References Cited

U.S. PATENT DOCUMENTS

| | | | |
|---|---|---|---|
| 2,784,631 | 3/1957 | Fender | 84/1.15 |
| 3,177,283 | 4/1965 | Fender | 84/1.15 |
| 3,290,424 | 12/1966 | Fender | 84/1.15 |
| 3,472,943 | 10/1969 | Kawabata | 84/1.15 |
| 3,544,696 | 12/1970 | Broussard | 84/1.15 |
| 3,915,048 | 10/1975 | Stich | 84/1.15 |

*Primary Examiner*—Gene Z. Rubinson
*Assistant Examiner*—William L. Feeney
*Attorney, Agent, or Firm*—Victor J. Evans

[57] ABSTRACT

Disclosed herein is a new and unique type of circuit control for an electric guitar. Simply stated, it varies the resonant frequency of the pickup itself in addition to filtering out frequencies which are suppressed or rolled off. The mechanism by which this is brought about includes a potentiometer connected to a center tap of the coil assembly.

4 Claims, 3 Drawing Figures

ELECTRIC GUITAR CIRCUITRY

BACKGROUND OF THE INVENTION

FIELD OF THE INVENTION

When compared with traditional guitar circuitry, prior art devices of which this inventor is aware have a relatively small field of range regarding its frequency response. This is due to the fact that an ordinary double coil pickup best seen in FIG. 1 which has two coils in series, has a single range modification potentiometer located at the output of these coils, and is connected in series with a capacitor.

Even arrangements which include a center tap for these coils in series, utilize an on/off switch which selectively engages one or both of the coils.

SUMMARY OF THE INVENTION

Acccordingly it is an object of this invention to provide a greater range in the frequencies possible than is normally to be expected from the coil described above, commonly referred to as a humbucking pickup.

This is made possible by providing the two coils connected in series with a center tap which is in turn connected to a capacitor through a variable potentiometer.

Accordingly it is an object of this invention to provide a guitar pickup which has a greater frequency range than that which has been evidenced by the prior art.

It is also an object of this invention to provide a circuit which provides the musician with greater flexiblity in projecting the tonal qualities that he desires.

Other objects and advantages will become apparent in the following specification when considered in light of the attached drawings.

DESCRIPTION OF THE PREFERRED EMBODIMENT

Figure 1:
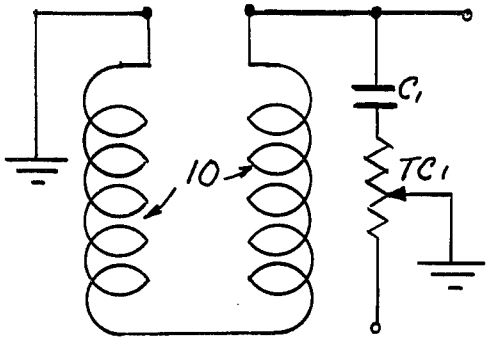
FIG. 1 shows prior art.

Referring to the drawings in which like numerals refer to like parts throughout, reference numeral 10 generally denotes a pair of inductive coils connected in a series.

As exampled above, FIG. 1 denotes a traditional means by which the tonal qualities of a guitar may be altered, A pair of coils 10 is disposed in series and the output derived therefrom is modified by the use of capacitor C1 and tone control means TC1. The effect that the variable potentiometer TC1 is to cause the undesired frequencies to roll off to ground.

Figure 2:
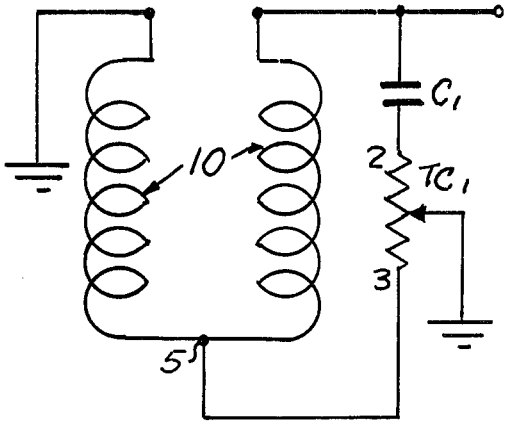
FIG. 2 shows the basic concept of this invention.

The distinctions between FIGS. 1 and 2 is most noticeably that the variable potentiometer TC1 of FIG. 2 is connected to the pair of coils at a center tap 5. When in the full bass position, that is, when the variable potentiometer TC1 is at position 2 at the top portion of resistor, the pickup operates as a full double coil pickup, and is analogous to the humbucking circuit of FIG. 1. In this mode the pickup has a low resonant frequency. Moving the potentiometer from position 2 to position 3 where the treble is maximized the resonant frequency gradually increases as one coil of the pickup is progressively grounded out. In this situation, the coil to the left on the schematic is the one which is grounded out.

Figure 3:
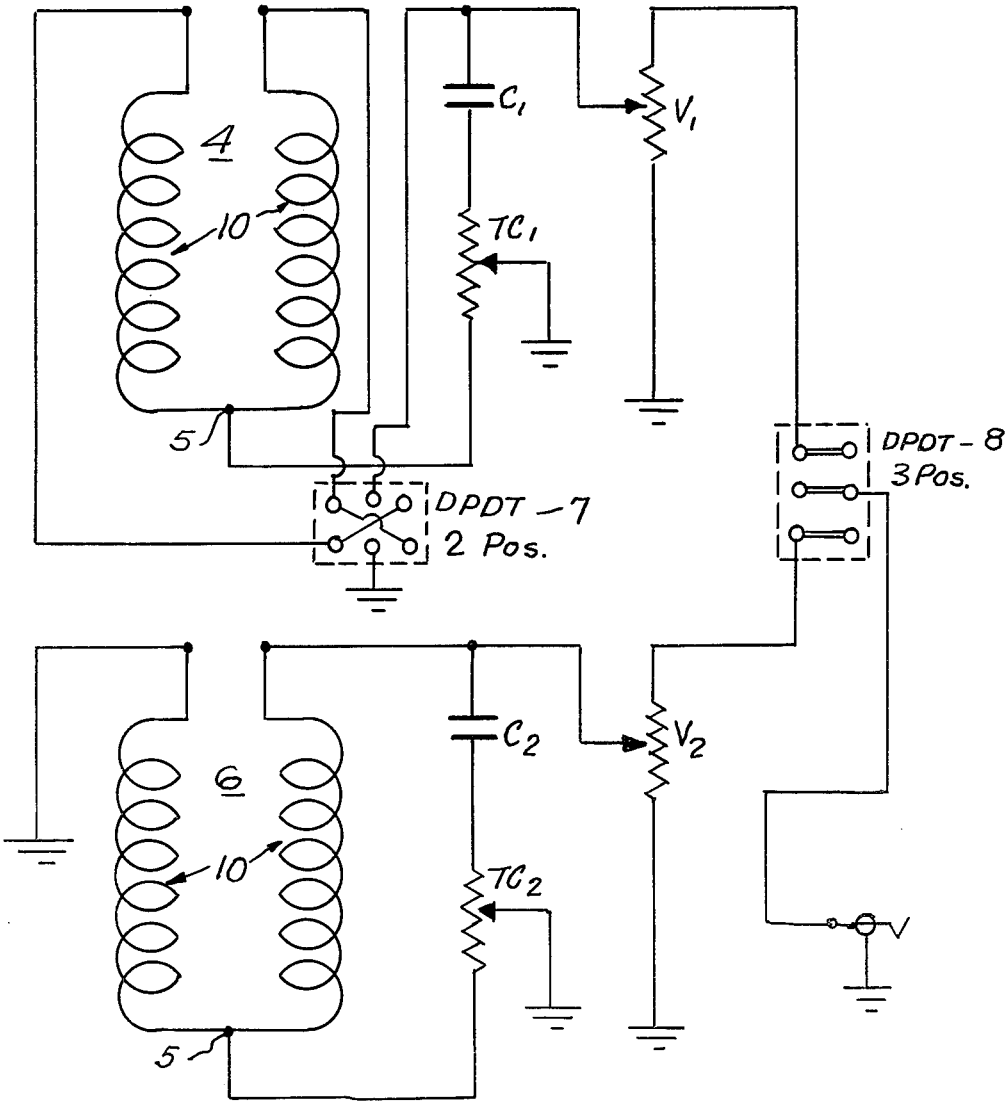
FIG. 3 shows the utilization of the element depicted in FIG. 2 in the actual circuit.

FIG. 3 shows the entire circuit which is typical of one which is to be deployed in an electric guitar. The top most pickup generally denoted by numeral 4 is for the treble, and its orientation on a guitar would characteristically be at the terminal portion of the string, at the point remote from the neck of the guitar. The bass pickup generally denoted by numeral 6 would be deployed closer to the neck and it is well known that this is the preferred location for maximizing the bass tonal qualities in a guitar.

The top portion of FIG. 3 and the bottom portion of FIG. 3 each substantially depict the circuit element shown in FIG. 2, with the exception of volume controls V1 and V2, which are each respectively associated with the treble and bass pickups. Also included is a double pole, double throw two position switch 7 which serves to change the phase relation of pickups 4 and 6.

This circuit allows the use of high frequencies which are normally present only in single coil pickups, and provides the added benefit of hum-cancellation which is a characteristic of double coil pickups except when the potentiometer TC1 is in the most extreme treble position. The overall volume level is not noticeably affected due to the presence of the high mid-range frequencies when in the treble mode.

The three position double pole, double throw switch numeral 8 serves as a pickup selector switch, so that either pickup may be utilized, or both of them together may be utilized, as is desired by the musician.

In operation, the guitar utilizing the circuitry is manipulated in exactly the same manner as the conventional guitar, and this means that the guitarist is aware merely of the added available frequency range, and is not immediately aware of how this effect is achieved. Furthermore prior art circuitry which has the capability of changing from a double coil pickup to single coil pickup through the mere use of a switch located in approximate relationship to tap 5 has the abrupt effect of radically changing the tonal qualities, and is not appealing to use in the middle of a song because of the rapid and abrupt change in the tonal qualities.

Having thus described the preferred embodiment of the invention it should be understood that numerous structural modifications and adaptations may be resorted to without departing from the spirit of the invention.

What is claimed is:

1. A pickup circuit for a guitar or the like comprising, in combination, a pair of coils, connected together at one end in series to provide a connection point, the opposite end of one of said coils connected to ground, said pair of coils being disposed in closely adjacent humbucking relationship as a single unit for positioning at a selected location on the guitar in close proximity to the strings, an output conductor connected to the opposite end of the other of said coils, a capacitor and a first potentiometer connected in series between said output conductor and said connection point forming a RC network, said potentiometer having a wiper connected to ground whereby the wiper serves as a signal input element, said wiper being movable progressively between one position for operation of the circuit as a full double coil humbucking pickup and a second position in which said one coil is grounded out and said other coil forms a single coil pickup.

2. The device of claim 1 further including a second potentiometer having a wiper in which said output conductor terminates in and serves as the wiper in the second potentiometer, whereby said first potentiometer alters tone and said second potentiometer alters loudness.

3. The device of claim 1 including a double pole double throw switch and a duplicate pickup circuit for positioning at another selected location with the two pickup circuits disposed in spaced-apart relationship on the guitar in close proximity to the strings wherein both circuits are controlled by the double pole double throw switch so that either or both circuits may be utilized.

4. The device of claim 3 including means to modify the phase relationship of one pair of coils wherein one of said pickup circuits is provided with means to modify the phase relationship of one pair of coils.

* * * * *